US010991525B2

(12) United States Patent
Lopez Lopez et al.

(10) Patent No.: US 10,991,525 B2
(45) Date of Patent: Apr. 27, 2021

(54) ELECTRICAL SWITCH

(71) Applicant: S.A.U. Simon, Barcelona (ES)

(72) Inventors: David Lopez Lopez, Barcelona (ES); Jordi Arderiu Costas, Barcelona (ES); Francesc Xavier Vasquez Villa, Barcelona (ES); Carlos Ferrer Martinez, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 0 days.

(21) Appl. No.: 16/306,328

(22) PCT Filed: Jun. 1, 2017

(86) PCT No.: PCT/ES2017/070391
§ 371 (c)(1),
(2) Date: Nov. 30, 2018

(87) PCT Pub. No.: WO2017/207858
PCT Pub. Date: Dec. 7, 2017

(65) Prior Publication Data

US 2019/0157026 A1 May 23, 2019

(30) Foreign Application Priority Data

Jun. 2, 2016 (ES) ..... ES201630734

(51) Int. Cl.
*H01H 21/36* (2006.01)
*H01H 3/46* (2006.01)
(Continued)

(52) U.S. Cl.
CPC ..... *H01H 21/36* (2013.01); *H01H 3/46* (2013.01); *H01H 13/52* (2013.01); *H01H 13/60* (2013.01);
(Continued)

(58) Field of Classification Search
CPC ..... H01H 21/36; H01H 3/46; H01H 13/52
(Continued)

(56) References Cited

U.S. PATENT DOCUMENTS

2012/0250234 A1 10/2012 Liang
2013/0032455 A1* 2/2013 Alberti ..... H01H 9/06 200/332.2

FOREIGN PATENT DOCUMENTS

DE 4303980 * 8/1994 ..... H01H 21/22
DE 4303980 A1 8/1994
(Continued)

OTHER PUBLICATIONS

International Search Report and Written Opinion for PCT/ES2017/070391, dated Oct. 24, 2017.

*Primary Examiner* — Renee S Luebke
*Assistant Examiner* — Iman Malakooti
(74) *Attorney, Agent, or Firm* — Kutak Rock LLP

(57) ABSTRACT

The electric switch comprises at least one key (4) that pivots about a pivoting axis (5) and a base (2) provided with at least one electric connection and disconnection actuation point (3), so that the pivoting of the key 4 causes the application of pressure to at least one actuation point 3 and causes the electric connection or disconnection, and it is characterized in that the base (2) comprises at least one pivoting actuator (6).

A low-cost mechanical type electric switch is obtained which automatically returns to its rest position, and which for the user has the same sensation as an electronic type electric switch.

20 Claims, 3 Drawing Sheets

(51) Int. Cl.
*H01H 21/24* (2006.01)
*H01H 13/52* (2006.01)
*H01H 13/60* (2006.01)

(52) U.S. Cl.
CPC ..... *H01H 21/24* (2013.01); *H01H 2221/09* (2013.01)

(58) Field of Classification Search
USPC ..... 200/343
See application file for complete search history.

(56) References Cited

FOREIGN PATENT DOCUMENTS

| | | | |
|---|---|---|---|
| WO | 2011075675 | A2 | 6/2011 |
| WO | 2011075675 | A3 | 6/2011 |

* cited by examiner

ELECTRICAL SWITCH

This is the United States National Stage of Patent Cooperation Treaty Application No. PCT/ES2017/070391 filed Jun. 1, 2017, which claims priority to Spanish Application No. ESP201630734 filed Jun. 2, 2016, the disclosures of which are incorporated herein by reference in their entireties.

The present invention relates to an electric switch, in particular to an electric switch comprising a pivoting activation key.

BACKGROUND OF THE INVENTION

The known electric switches currently comprise a key mounted on a base provided with an actuation point, said key being pivotable about a pivoting axis. This key defines two positions: a first contact position or electric connection position and a second disconnection position or rest position.

From this second rest position, when the user presses the key, it switches to the first contact position, in which it can be maintained or, if desired, it can automatically return to the second position, e.g. by a spring. When this automatic return occurs, each time the key is pressed, the electric contact will be connected and disconnected when the key is not pressed, or the electric contact will be connected and disconnected alternately when the key is pressed.

In these electric switches in which the key automatically returns to its rest position, it is usual that said key substantially protrudes from the base at its end furthest from the pivoting axis. The reason is the presence of a mechanical mechanism for electric driving, which occupies considerable space.

In order to overcome this drawback, electric switches of this type are also known which use electronic mechanisms for electric driving, which have the advantage that the key protrudes just a little from the frame at its end remote from the pivoting axis. However, these electronic mechanisms are substantially more expensive than the mechanical mechanisms and increase the cost price of the electric switch.

Therefore, the object of the present invention is to provide an electric switch in which the key protrudes about the same as the presently known electronic switches which automatically return to their rest position, but by a fully mechanical mechanism. This way, the sensation that a user has is to use an electronic type electric switch, but in reality it is a mechanical type electric switch.

Disclosure of the Invention

With the electric switch of the invention said drawbacks are solved, presenting other advantages that will be disclosed below.

The electric switch according to the present invention comprises at least one key rotatable about a pivoting axis and a base provided with at least one actuation point of electric connection or disconnection for each key, so that the rotation of the key presses said activation point and causes the electric connection or disconnection, and it is characterized in that the base comprises a pivoting actuator for each actuation point formed by a proximal portion and a distal portion, which preferably define an actuation angle.

Advantageously, said proximal portion of said actuator comprises a rotation axis at its end remote from the center of the frontal surface of the base and said distal portion is in contact with the actuation point when the key associated therewith is pressed.

According to a preferred embodiment, said distal portion comprises a protrusion for contacting said actuation point.

Preferably, the distal portion forms an angle with an axis normal to the base of the key at the actuation point of between 0 and 90 degrees.

In a preferred embodiment, the ratio between the distance running through the end of the distal portion remote from the rotation axis in the direction perpendicular to the base and the distance running through the end of the key remote from the pivoting axis in the perpendicular direction to the base is comprised between 0.7 and 3, it being more preferred that said ratio is between 0.8 and 2, and more preferably about 1. In this way, a compromise is achieved between the minimum travel of the end of the key remote from the pivoting axis and the driving force.

Furthermore, it has been provided that the distance running through the free end of the distal portion in the direction perpendicular to the base may advantageously be between 2.5 and 1.5 mm, e.g. 2 mm, and the distance running through the end of the key remote from the pivoting axis in the direction perpendicular to the base is between 2.5 and 1.5 mm, e.g. 2 mm. In addition, the distance running through the center of the key is between 0.5 and 1.5 mm, such as 1 mm.

With the switch according to the present invention, a low-cost mechanical type electric switch is obtained which automatically returns to its rest position, and which for the user provides the same sensation as an electronic type electric switch.

In addition, the force that the user must perform to operate the switch is the same as in conventional switches, since the travel of the key is the same.

BRIEF DESCRIPTION OF THE DRAWINGS

For better understanding of what has been disclosed, some drawings are accompanied, in which, schematically and only by way of a non-limiting example, a practical case of embodiment is shown.

DESCRIPTION OF A PREFERRED EMBODIMENT

Figure 1:
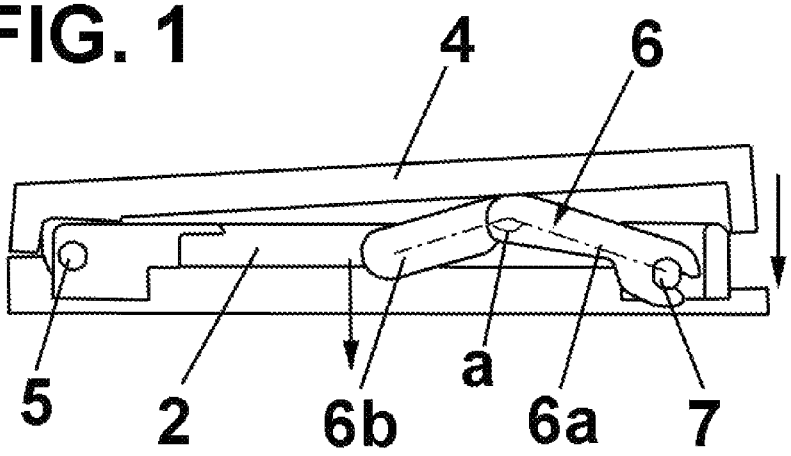
FIG. 1 is a sectional view of the electric switch of the present invention in its rest position.

The electric switch according to the present invention comprises one or more bases 2 and one or more keys 4. In the case of using more than one key 4, preferably each key is of the same size.

In addition, said base 2 or each base 2 is provided with an actuation point 3 for connection and disconnection, each key 4 being pivotable with respect to a pivoting axis 5, which pivoting presses said actuation point 3 and causes the electric connection or disconnection.

Figure 5:
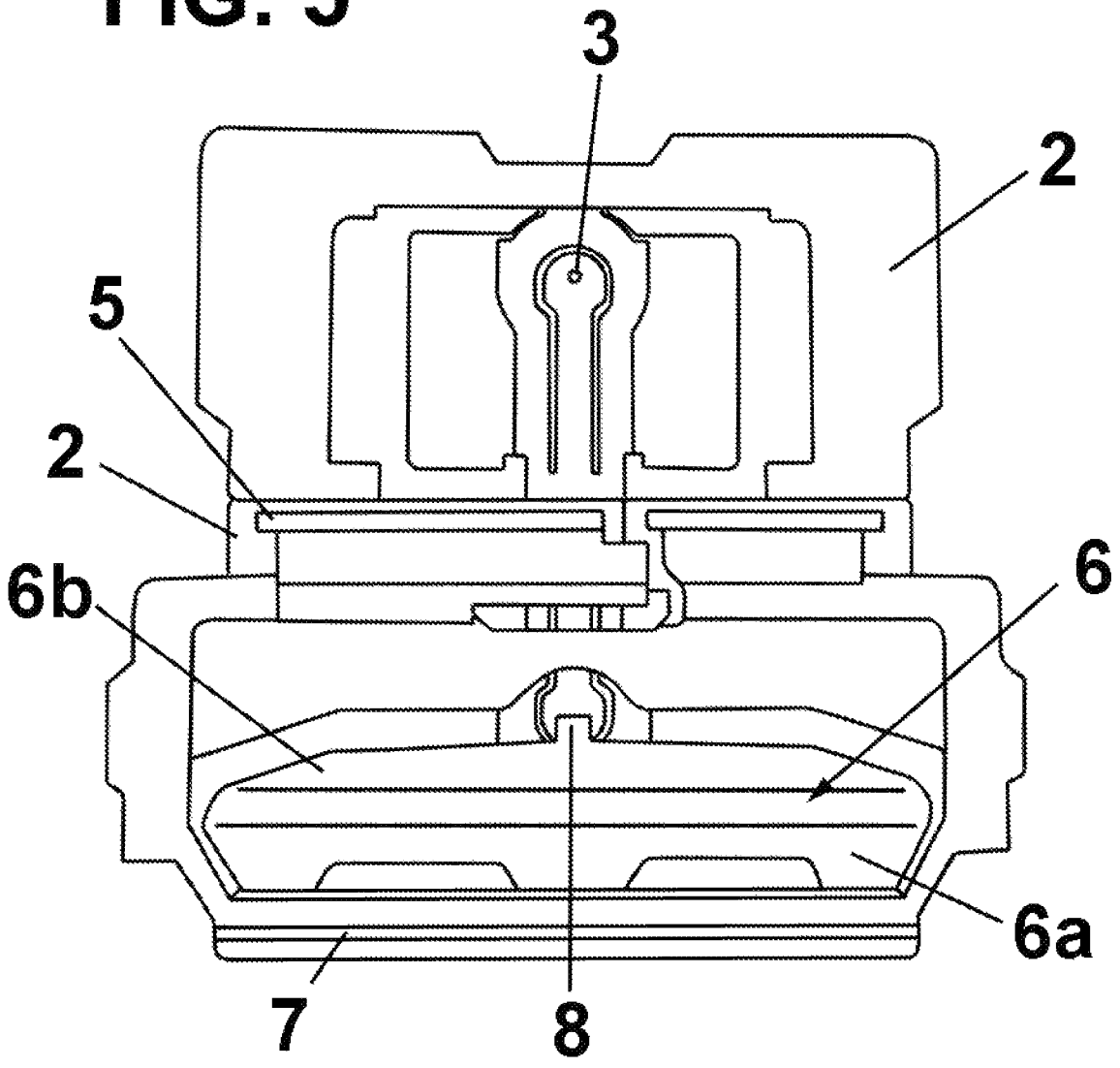
FIG. 5 is a plan view of the electric switch of the present invention, comprising two bases.

In addition, each actuation point 3 is preferably located approximately in the center of each key 4, as can be seen in FIG. 5.

It should be noted that an electric switch comprising two bases is shown in FIG. 5. In order to allow the actuator 6 to be shown and the bases 2, the corresponding keys 4 have been removed in this figure, and the actuator 6 has been removed in the upper half.

Figure 2:
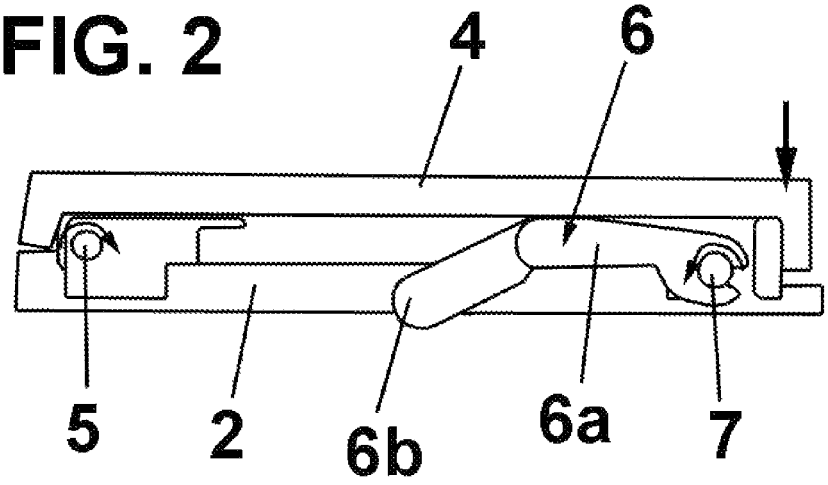
FIG. 2 is a sectional view of the electric switch of the present invention in its operating position.

In FIGS. 1 and 2 it can be seen that the base 2 comprises a pivoting actuator 6 formed by a proximal portion 6*a* and a distal portion 6*b*, defining preferably an actuation angle (a). For example, said actuation angle (a) may be between 175° and 5°, preferably is between 140° and 70°, and more preferably 110° and 130°, e.g. 120°.

Furthermore, said proximal portion 6*a* of the pivoting actuator 6 comprises a rotation axis 7 at its end remote from the center of the base and said distal portion 6*b* is in contact with the actuation point 3 by its free end when said key 4 is pressed. In this position, the distal portion forms an angle with an axis normal to the base of the key at the actuation point 3, which is between 0 and 90 degrees.

In a preferred embodiment, the ratio D3/D2 is between 0.7 and 3, it being more preferred that said ratio is between 0.8 and 2, and more preferably about 1, where D3 is the distance that travels the end of the distal portion remote from the rotation axis in the direction perpendicular to the base, and D2 is the distance that travels the end of the key remote from the pivoting axis in the direction perpendicular to the base. This way, a compromise is achieved between minimum travel D2, the drive force and the proportions of the pivoting actuator 6 with respect to the dimensions of the key.

In order to determine the optimal value of the ration D3/D2, two factors are considered:

Small travel D2 which provides the electronic switch effect, but being mechanical.

Small driving force.

The driving force, for a determined travel D2 of the key, increases with the travel D3 of the free end of the distal portion for a given actuation angle. The higher the actuation angle the greater the driving force for the determined travels D2 of the key and D3 of the free end of the pivoting actuator. In small size keys, the dimension of the pivoting actuator 6 forces the defined angle between the distal portion and an axis normal to the base of the key at the actuation point 3 to be between 0 and 90 degrees.

So that D3/D2=5 with an angle defined between the distal portion and an axis normal to the base of the key at the actuation point 3 between 0° and 90° would also have an acceptable small travel D2 but increases the driving force, and D3/D2=0.2 would have a small driving force, but the key travel D2 would be greater, so that in none of these cases the desired effect of electronic switch is obtained.

According to a preferred embodiment, distance D3 running along the end of the distal portion 6*b* remote from the rotation axis 7 in the direction perpendicular to the base 2 is advantageously between 2.5 and 1.5 mm, for example 2 mm, the distance D2 running along the end of the key 4 remote from the pivoting axis 5 in the direction perpendicular to the base 2 is between 2.5 and 1.5 mm, for example 2 mm, and distance D1 running the center of the key 4 is between 0.5 and 1.5 mm, such as 1 mm.

The dimensions specified in the previous paragraph may be larger if the lengths L1+L2 are larger.

Figure 3:
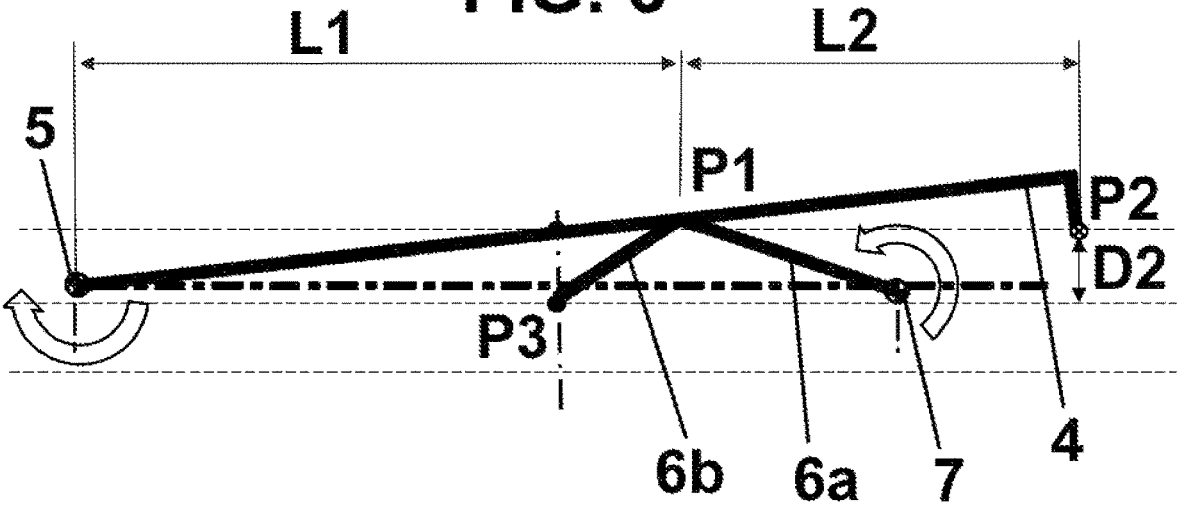
FIGS. 3 and 4 are schematic views of the position of the key and the pivoting actuator in the rest position and the operating position respectively.
Figure 4:
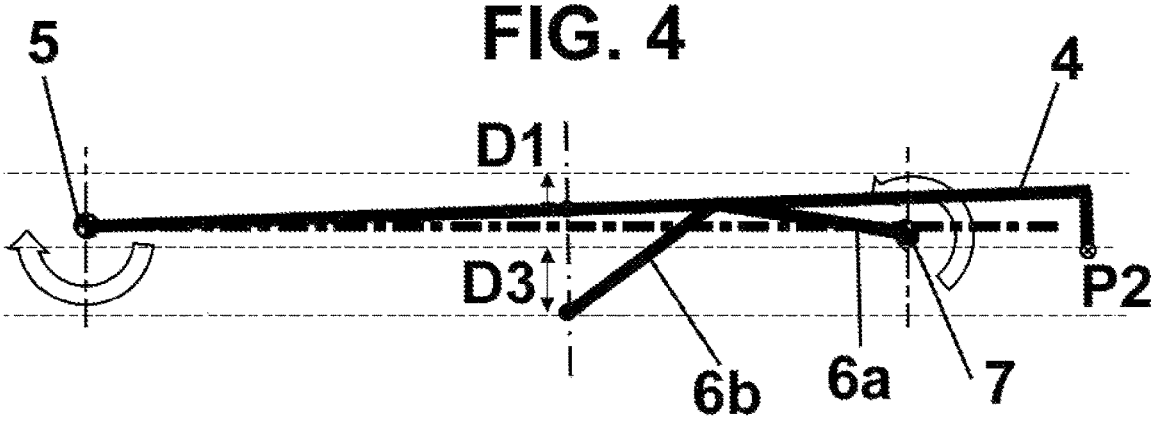

For a better understanding, the positions of the key 4 and the actuator 6 are shown schematically in FIGS. 3 and 4, in the rest position (FIG. 3) and in the actuating position (FIG. 4).

In these figures, the following reference points are shown:

P1: Point at which the intersection of the proximal 6*a* and distal 6*b* portions contacts the inner surface of the key;

P2: Limit point of maximum movement of the key 4;

P3: Actuation point of the pivoting actuator 6;

L1: Distance between the pivoting axis 5 and point P1;

L2: Distance between the rotating axis 7 and point P1.

In one embodiment, the pivoting actuator 6 optimizes the ratio D3/D2, so that:

When P2 travels 2 mm (D2), P1 travels 1 mm (D1);

When P2 travels 2 mm (D2), P3 travels 2 mm (D3);

By setting the travel D2, and the actuation angle a, when L1 increases, D3 increases and increases the driving force;

By setting the travel D2, and the actuation angle a, when L1 decreases, D3 decreases and decreases the driving force.

As can be seen in FIGS. 1 and 2, when the key 4 is pressed at its end remote from the pivoting axis 5, the lower part of the key 4 pushes on the actuator 6, in particular, on the intersection between the proximal portion 6*a* and the distal portion 6*b*.

This push causes the actuator 6 to pivot about the rotation axis 7, so that the protrusion 8, or failing it the end of the distal portion 6*b* closest to the pivoting axis 5, it presses the actuation point 3, causing the electric connection or disconnection.

When the user stops pressing the key 4, the actuator 6 will automatically return to its rest position (shown in FIG. 1). This automatic return is done by means of elastic means, for example, one or more springs, which are not shown in the figures, and which may be conventional.

Although reference has been made to specific embodiments of the invention, it is apparent to a person skilled in the art that the described electric switch is susceptible of numerous variations and modifications, and that all the details mentioned can be replaced by other technically equivalents, without departing from the scope of protection defined by the appended claims.

The invention claimed is:

1. An electric switch comprising at least one key (4) that pivots about a pivoting axis (5) and a base (2) provided with at least one electric connection and disconnection actuation point (3), so that the pivoting of the key (4) causes the application of pressure to at least one actuation point (3) and causes the electric connection or disconnection, the base (2) comprising at least one pivoting actuator (6), wherein the at least one pivoting actuator (6) comprises a proximal portion (6*a*) and a distal portion (6*b*) provided to press the at least one actuation point (3), characterized in that said proximal portion (6*a*) of said actuator (6) comprises a rotation axis (7) that is placed on an end of the proximal portion (6*a*) that is remote from a center of the key (4) and said distal portion (6*b*) is in contact with the actuation point (3) by pressing the key (4) associated therewith.

2. The electric switch according to claim 1, wherein said proximal portion (6*a*) and said distal portion (6*b*) define an actuation angle (a).

3. The electric switch according to claim 2, wherein said actuation angle (a) is comprised between 110° and 130°.

4. The electric switch according to claim 3 wherein the distal portion (6) forms an angle with a normal axis to the base (2) of the key (4) at the actuation point (3) between 0 and 90 degrees.

5. The electric switch according to claim 4, wherein said distal portion (6*b*) comprises a protrusion (8) for contacting said actuation point (3).

6. The electric switch according to claim 5, wherein from the position when the key (4) is not pressed to the position when the key (4) is pressed, a distance (D3) that the end of the distal portion (6*b*) remote from the rotation axis (7) travels in the direction perpendicular to the base (2) is between 2.5 and 1.5 mm.

7. The electric switch according claim 6, wherein from the position when the key (4) is not pressed to the position when the key (4) is pressed, a distance (D2) that the end of the key (4) remote from the pivoting axis (5) travels in the direction perpendicular to the base (2) is between 2.5 and 1.5 mm.

8. The electric switch according to claim 7, wherein the ratio between the distance (D3) that the end of the distal portion (6*b*) remote from the rotation axis (7) travels in the direction perpendicular to the base (2) from the position when the key (4) is not pressed to the position when the key (4) is pressed and the distance (D2) that the end of the key (4) remote from the pivoting axis (5) travels in the direction perpendicular to the base (2) from the position when the key (4) is not pressed to the position when the key (4) is pressed is between 0.7 and 3.

9. The electric switch according to claim 8, wherein the ratio between the distance (D3) that the end of the distal portion (6*b*) remote from the rotation axis (7) travels in the direction perpendicular to the base (2) from the position when the key (4) is not pressed to the position when the key (4) is pressed and the distance (D2) that the end of the key (4) remote from the pivoting axis (5) travels in the direction perpendicular to the base (2) from the position when the key (4) is not pressed to the position when the key (4) is pressed is approximately 1.

10. The electric switch claim 9, wherein from the position when the key (4) is not pressed to the position when the key (4) is pressed a distance (D1) that the center of the key (4) travels is between 0.5 and 1.5 mm.

11. The electric switch according to claim 10, wherein the distance (D1) that the center of the key (4) travels is 1 mm.

12. The electric switch according to claim 7, wherein the distance (D2) that the end of the key (4) remote from the pivoting axis (5) travels in the direction perpendicular to the base (2) is 2 mm.

13. The electric switch according to claim 1, wherein the distal portion (6) forms an angle with a normal axis to the base (2) of the key (4) at the actuation point (3) between 0 and 90 degrees.

14. The electric switch according to claim 1, wherein said distal portion (6*b*) comprises a protrusion (8) for contacting said actuation point (3).

15. The electric switch according to claim 1, wherein from the position when the key (4) is not pressed to the position when the key (4) is pressed, a distance (D3) that the end of the distal portion (6*b*) remote from the rotation axis (7) travels in the direction perpendicular to the base (2) is between 2.5 and 1.5 mm.

16. The electric switch according to claim 1, wherein from the position when the key (4) is not pressed to the position when the key (4) is pressed, a distance (D2) that the end of the key (4) remote from the pivoting axis (5) travels in the direction perpendicular to the base (2) is between 2.5 and 1.5 mm.

17. The electric switch according to claim 16, wherein the distance (D2) that the end of the key (4) remote from the pivoting axis (5) travels in the direction perpendicular to the base (2) is 2 mm.

18. The electric switch according to claim 1, wherein the ratio between a distance (D3) that the end of the distal portion (6*b*) remote from the rotation axis (7) travels in the direction perpendicular to the base (2) from the position when the key (4) is not pressed to the position when the key (4) is pressed and a distance (D2) that the end of the key (4) remote from the pivoting axis (5) travels in the direction perpendicular to the base (2) from the position when the key (4) is not pressed to the position when the key (4) is pressed is between 0.7 and 3.

19. The electric switch according to claim 1, wherein from the position when the key (4) is not pressed to the position when the key (4) is pressed a distance (D1) that the center of the key (4) travels is between 0.5 and 1.5 mm.

20. The electric switch according to claim 19, wherein the distance (D1) that the center of the key (4) travels is 1 mm.

* * * * *